United States Patent [19]

Banner et al.

[11] 4,396,059

[45] Aug. 2, 1983

[54] INSERT FOR A CONDENSER TUBE

[75] Inventors: Alan Banner; Frank Banner, both of Leatherhead, England

[73] Assignee: Ensign Plastics, Limited, Surrey, England

[21] Appl. No.: 308,256

[22] Filed: Oct. 5, 1981

[51] Int. Cl.[3] ..... F28F 19/00

[52] U.S. Cl. ..... 165/134 R

[58] Field of Search ..... 165/134 R, 178, DIG. 8

[56] References Cited

U.S. PATENT DOCUMENTS

| | | | |
|---|---|---|---|
| 2,143,477 | 1/1939 | Dillon et al. | 165/134 R |
| 2,484,904 | 10/1949 | Pennella | 165/178 X |
| 2,716,428 | 8/1955 | Pennella | 165/134 X |
| 2,864,588 | 12/1958 | Booth et al. | 165/133 |
| 2,914,915 | 12/1959 | Sziklas et al. | 165/133 |
| 2,966,373 | 12/1960 | Yount | 165/178 X |
| 3,592,261 | 7/1971 | Black | 165/178 |
| 3,707,186 | 12/1972 | Zorrilla et al. | 165/134 R |
| 4,254,819 | 3/1981 | Worrell | 165/134 R |

FOREIGN PATENT DOCUMENTS

| | | | |
|---|---|---|---|
| 1249596 | 10/1971 | United Kingdom | 165/DIG. 8 |
| 1344812 | 1/1974 | United Kingdom | 165/134 R |

*Primary Examiner*—Sheldon J. Richter

*Attorney, Agent, or Firm*—Phillips, Moore, Lempio & Finley

[57] ABSTRACT

An insert for condenser tubes of the heat exchanger includes steps or other means to restrict movement of the boundary layer of liquid through the tubes or to remove the energy of that boundary layer.

11 Claims, 1 Drawing Figure

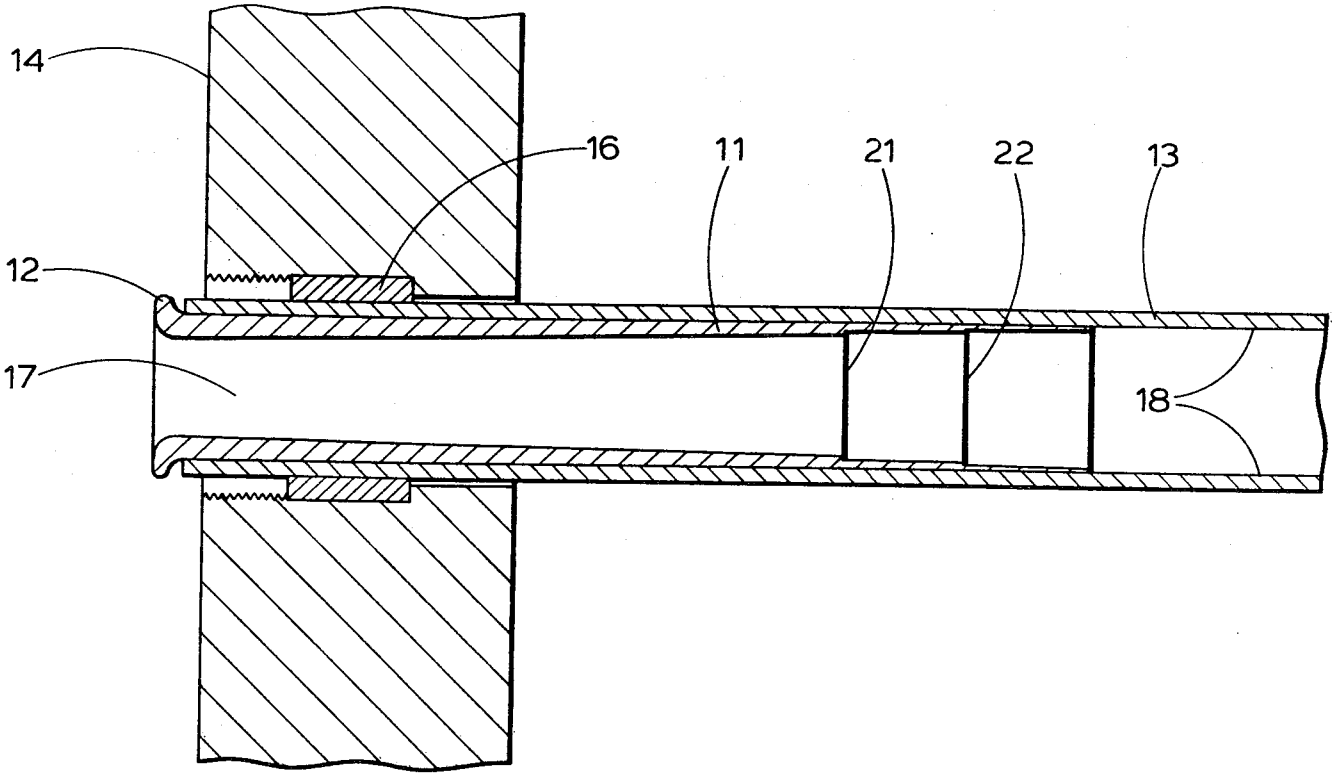
14
16
11
21
22
13
18
12
17

INSERT FOR A CONDENSER TUBE

The present invention relates to an insert for a condenser tube.

In heat exchangers such as steam condensers or other condensers widely used in power stations or associated with ship's turbines, a very large number of condenser tubes pass through the heat exchanger or steam chest. The condenser tubes are typically supported between two end plates of the heat exchanger and there may be several thousands of such tubes each twelve meters or more in length. A cooling liquid such as water is passed through the tubes to cool the steam or other fluid within the heat exchanger. The inlet end of the condenser tubes are often protected from erosion by means of an insert.

The invention relates to improvements in inserts for condenser tubes of the type comprising a tube of water-swellable plastics material having, adjacent its upstream end, a restricted throat. The use of water-swellable plastics material allows the tube, once inserted in the condenser tube, to swell and grip the condenser tube and the restricted throat, apart from smoothing the flow of water through the condenser tube, prevents the ingress of large particles which might otherwise block the condenser tube.

The use of such inserts has very substantially reduced the occurrence of erosion at the inlet end of the condenser tube and they have therefore been very widely adopted.

Such protective inserts are described more fully in our British Pat. No. 1247429.

Although such inserts have been very successful, there has remained slight problems in cases where the water passing through the condenser tubes is particularly abrasive (for example in the case of power stations using sea water as a cooling fluid in which some sand particles are picked up with the sea water) in that erosion of the condenser tube has taken place immediately beyond the downstream end of the insert. This problem has been reduced as far as possible by making the downstream end of the wall of the insert to be as thin as possible but inevitably there must be come thickness of wall at the downstream end if the insert is to be properly moulded. Attempts to overcome this minor remaining problem have hitherto been focused in two directions, firstly by removing the inserts and replacing them with a longer insert when erosion has taken place thereby covering the area of the erosion and secondly by arranging the inner surface of the insert tube to be as smooth as possible.

The present inventors have made the surprising discovery, however, that the problem of erosion beyond the end of the insert may be reduced or overcome by providing an insert in which the inner surface between the throat and the downstream end includes means to restrict movement of the boundary layer of liquid through the tube or means to remove the energy from that boundary layer. This may be provided, for example, by providing a roughened inside surface or by providing other discontinuities rather than having a very smooth surface as hitherto. In the preferred arrangement there is provided steps.

An insert in accordance with the invention will now be described by way of example only and with reference to the accompanying drawing which is an axial section through such an insert inserted into a condenser tube.

In the drawing an insert is provided in the form of a tube 11 of water swellable plastics material, the tube having at its upstream end an outwardly extending flange 12 and having a wall of generally tapering thickness being thicker at the end near the flange 12. The insert is moulded from a plastics material, for example, a nylon, which is hygroscopic and which expands on absorption of water. The insert is accordingly moulded to close tolerances so that whilst it is dry it is a close sliding fit within the end of a condenser tube 13. Once the insert is immersed in water it absorbs moisture and expands conforming exactly to the shape of the inside of the condenser tube, and locking itself firmly in place. In order to prevent the inserts from expanding before they have been inserted in the condenser tubes, they are supplied dry in sealed drums.

As is clear from this figure, the condenser tube 13 is supported in an end plate 14 of the heat exchanger, there being provided packing 16 between the condenser tube 13 and the end plate 14. The insert is placed in position by sliding it into the end of the condenser tube 13 until its flange generally abuts the inlet end of the condenser tube 13.

A throat 17 is provided by the thicker wall of the tube 11 adjacent the upstream end of the tube, the throat preventing the ingress of large material which might obstruct the condenser tube. It furthermore smooths the passage of water through the condenser tube.

As has been mentioned above, it has been found that in certain severe circumstances some erosion of the condenser tube takes place beyond the downstream end of the insert tube 11 in the area indicated by numeral 18. There is provided towards the downstream end of the insert tube 11 on its inner surface two steps 21, 22 in the form of annular downstream facing shoulders, the steps being 0.5 mm deep and 20 mm apart, the most downstream step being spaced 20 mm from the downstream end of the insert tube 11.

The steps 21, 22 form discontinuities in the inner surface of the tube and it is believed that they restrict the movement of the boundary layer of the water passing through the tube and also remove the energy in the boundary layer. Furthermore it is also believed that the steps produce a thicker boundary layer than hitherto thereby protecting the area 18 from erosion to a greater extent.

The invention is not restricted to the details of the foregoing example. Thus the invention may also be applied to inserts of the type shown in our British Pat. No. 1249594.

We claim:

1. A tubular insert disposed in a condenser tube and composed of a swellable plastics material swollen into gripping relationship within the condenser tube, said insert having a restrictive throat adjacent to its upstream end and step means adjacent to its downstream end to restrict axial movement of the boundary layer of liquid therepast and to remove energy from the boundary layer, thereby reducing erosion of the condenser tube adjacent thereto and downstream thereof.

2. The insert of claim 1 in which the step means comprises axially spaced annular shoulders facing downstream.

3. The insert of claim 2 in which said steps are each substantially 0.5 mm deep in a radial direction and are sequentially spaced-apart substantially 20 mm from each other in an axial direction.

4. The insert of claim 2 in which the furthest downstream step is spaced axially substantially 20 mm from the downstream end of said insert.

5. An insert for a condenser tube comprising a tube of water-swellable plastics material to allow the tube, once inserted in the condenser tube, to swell and grip the condenser tube said insert having, adjacent its upstream end, a restricted throat, the inner surface between the throat and the downstream end of the insert including means, comprising a roughened inside surface, to restrict axial movement of the boundary layer of liquid through the tube and to remove energy from that boundary layer whereby erosion of the condenser tube will be reduced.

6. An insert as claimed in claim 5 in which said means comprises discontinuities in said inside surface.

7. An insert as claimed in claim 6 in which said means comprises steps in said inside surface.

8. An insert as claimed in claim 7 in which said steps are in the form of annular shoulders facing downstream.

9. An insert as claimed in claim 7 or claim 5 in which said steps are substantially 0.5 mm deep and substantially 20 mm apart.

10. An insert as claimed in claim 9 in which the most downstream step is substantially 20 mm from the downstream end of the insert tube.

11. In a heat exchanger having a fluid-conducting condenser tube and a tubular inset expanded into gripping relationship within an upstream end of said condenser tube, the improvement comprising means positioned at a downstream end of said insert to restrict axial movement of the boundary layer of liquid therepast and to remove energy from the boundary layer for reducing erosion of the condenser tube adjacent thereto and downstream thereof.

* * * * *